US006988480B2

(12) United States Patent
Hughes et al.

(10) Patent No.: US 6,988,480 B2
(45) Date of Patent: Jan. 24, 2006

(54) CYLINDER BLOCK FOR AN INTERNAL COMBUSTION ENGINE HAVING A LOCALLY THICKENED END WALL

(75) Inventors: Frank G. Hughes, Stamford (GB); Richard Jackson, Norfolk (GB); Howard J. Paul, Stamford (GB)

(73) Assignee: Caterpillar Inc., Peoria, IL (US)

( * ) Notice: Subject to any disclaimer, the term of this patent is extended or adjusted under 35 U.S.C. 154(b) by 81 days.

(21) Appl. No.: 10/662,807

(22) Filed: Sep. 16, 2003

(65) Prior Publication Data

US 2005/0028758 A1 Feb. 10, 2005

Related U.S. Application Data

(60) Provisional application No. 60/411,510, filed on Sep. 16, 2002.

(51) Int. Cl.
*F02F 1/14* (2006.01)

(52) U.S. Cl. ..... 123/195 R; 123/41.72

(58) Field of Classification Search ..... 123/195 R, 123/41.72, 41.74, 41.79
See application file for complete search history.

(56) References Cited

U.S. PATENT DOCUMENTS 4,175,503 A * 11/1979 Ernest ..... 123/41.72
4,212,281 A * 7/1980 Ernest ..... 123/193.5
4,850,312 A 7/1989 Schwab
5,450,827 A 9/1995 Kang
5,462,108 A 10/1995 Katoh et al.
5,501,189 A 3/1996 van Bezeij
5,562,073 A 10/1996 Van Bezeij et al.
5,809,946 A 9/1998 Abe
5,988,120 A 11/1999 Betsch et al.
6,070,562 A 6/2000 Van Bezeij
6,101,994 A * 8/2000 Ichikawa ..... 123/195 R
6,135,081 A 10/2000 Eidenboeck et al.
6,202,603 B1 3/2001 Etemad
6,263,840 B1 7/2001 Avramidis
6,298,818 B1 10/2001 Koyama et al.

FOREIGN PATENT DOCUMENTS

EP 0 928 891 A2 7/1999

* cited by examiner

*Primary Examiner*—Henry C. Yuen
*Assistant Examiner*—Jason Benton
(74) *Attorney, Agent, or Firm*—Finnegan Henderson Farabow Garrett & Dunner

(57) ABSTRACT

Increasing the diameter of cylinder bores in a cylinder block requires a longer and heavier cylinder block to accommodate the larger bores. If the cylinder block is not lengthened it is difficult to accommodate the water jacket between the outermost cylinder bore and the cylinder block end wall. The cylinder block of the present invention has an upper part including a number of cylinder bores surrounded by a water jacket. The upper part also has first and second end walls which are generally co-planar with first and second end walls of a lower part of the block, but include projecting portions adjacent the top deck. The projecting portions may curve outwardly from the first and second end walls and generally follow the curvature of the two outermost cylinder bores on the block. By providing the projecting portions on the first and second end walls, a minimum width of water jacket can be accommodated without significantly increasing the length and overall size of the block.

20 Claims, 5 Drawing Sheets

CYLINDER BLOCK FOR AN INTERNAL COMBUSTION ENGINE HAVING A LOCALLY THICKENED END WALL

CROSS-REFERENCE TO RELATED APPLICATIONS

This application claims the benefit of commonly-owned provisional application No. 60/411,510 filed on Sep. 16, 2002.

TECHNICAL FIELD

The present invention is directed to a cylinder block for an internal combustion engine of the type having a water jacket surrounding one or more cylinder bores.

BACKGROUND

In conventional engine manufacture, the size of the cylinder block is normally dictated by the capacity of the cylinder bores. In particular, the surface area of the top deck of the block is affected by the diameter of each of the cylinder bores. As a result, increasing the capacity of a cylinder block by increasing the diameter of the cylinder bores requires a larger and heavier cylinder block to accommodate the larger bores. This increase in the size and weight of the block will negate to a certain extent the improvement in performance provided by the increased engine capacity created by the larger diameter bores.

As a result of this disadvantage, engine manufacturers have attempted to obtain greater cylinder bore dimensions, and hence engine cubic capacity, within an engine block without substantially adding to the size and weight of the block itself. The disadvantage of such arrangements is that increasing the bore diameters without lengthening the block means that the space between the end walls of the block and the walls of the outermost cylinder bores becomes limited. As a water jacket must be located between the cylinder bores and the end walls, the transverse portions of the water jacket between the end walls and outermost bores must be thinner than usual because of the reduction in space.

As will be understood by those skilled in the art, the conventional way in which to define a water jacket during cylinder block casting is to use moulded sand cores in the block mould. However, if the transverse portions of the water jacket between the end walls and outermost bores are too thin, the thinner sand cores needed to define the thinner transverse portions of the water jacket may not be strong enough during casting. If the cores are too thin they may tend to crack or deform. Thus, efficient block casting of compact but increased capacity blocks remains difficult.

A cast cylinder block is provided with a variety of internal volumes, apertures and recesses that define various elements within the block itself. In conventional engine block casting, the shape or profile of such internal features is dictated by the shape of sand cores which are pre-moulded and placed within a cylinder block mould prior to the metal being cast into the mould. These cores themselves are shaped in core boxes, which are conventionally split into two parts, with the split between the two parts at either the top or bottom of the box in order that the formed cores may be removed. However, the shape that the cores can be formed in—and hence the shape of the internal features in the cylinder block—is limited, as the cores must be easily removed from the core box prior to insertion into the cylinder block mould. With the split in the core box at either the top or bottom of the box, the cores must only taper longitudinally in one direction if they are still to be easily removed from the core box.

This problem of core shape is especially significant when considering the profile of a water jacket for a cylinder block, where the water jacket is positioned between the side wall of the block and the cylinder bores. As the cores can only taper in one direction, the water jacket created by the core also only tapers in one direction, narrowing when viewed in transverse section from the top deck of the block downwards. This presents problems in that the water jacket cannot be particularly deep given the single taper, and the cylinder bores must also be relatively far apart so that there is room on the deck of the block for machining additional features. Furthermore, with a water jacket which is wider at the top of the block the wall thickness between the bore and jacket will be relatively thin, which is not desired when the combustion—and hence greatest heat transfer—occurs at the top of the cylinder bore.

Conventional cylinder blocks are also cast such that the water jackets are closed at the top thereof. This is disadvantageous in the manufacturing process as it prevents easy cleaning and inspection of the block after both casting and machining.

It is an aim of the present invention to obviate or mitigate one or more of the aforementioned problems.

SUMMARY OF THE INVENTION

According to a first aspect of the present invention there is provided a cylinder block for an internal combustion engine comprising at least one cylinder bore, a coolant jacket surrounding the at least one cylinder bore, a top deck, and first and second longitudinally opposed end walls, each of the first and second end walls having a substantially planar end wall surface arranged on respective first and second planes. The coolant jacket includes a first portion located between the first end wall and the at least one cylinder bore, and a second portion located between the second end wall and the at least one cylinder bore. At least one of the first and second end walls includes a projecting portion adjacent the top deck that projects longitudinally beyond the first or second plane.

According to a second aspect of the present invention there is provided an internal combustion engine including the cylinder block according to the first aspect of the present invention.

BRIEF DESCRIPTION OF THE DRAWINGS

A preferred embodiment of the present invention will now be described, by way of example only, with reference to the accompanying drawings, in which.

DETAILED DESCRIPTION

Figure 1:
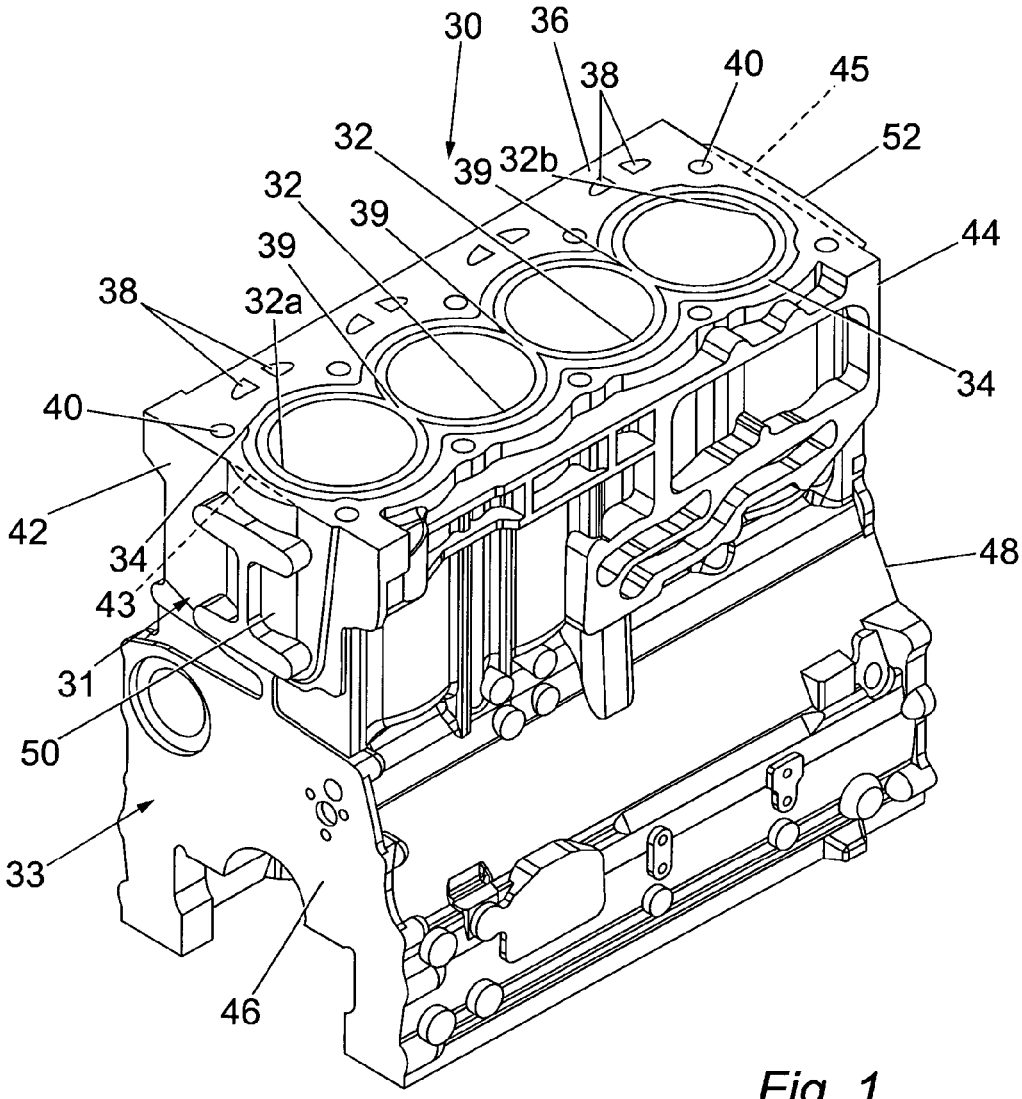
FIG. 1 is a perspective view of a cylinder block.

FIG. 1 shows a cylinder block in accordance with the present invention. The block 30 is a one piece casting which includes an upper part 31 and a lower part 33. The upper part 31 houses a number of cylinder bores 32 and a coolant jacket 34 surrounding the bores 32. The coolant jacket 34 is referred to in the specification as a water jacket, but it is to be understood that any suitable coolant may be used, and that the jacket 34 may include any suitable chamber at least partially surrounding the cylinder bores 32. In this embodiment, the bores 32 are linerless and have conjoined walls 39, such that the water jacket 34 does not extend between the bores 32. The block 30 is of open deck construction, whereby the water jacket 34 is open on the top deck 36. During engine assembly a gasket (not shown) is placed directly on the water jacket 34 before a cylinder head (not shown) is attached to the block 30. The block 30 is also provided with conventional features such as threaded apertures 40 for receiving cylinder head attachment bolts (not shown) and also ventilation passages 38 which allow for removal of casting material from the block following casting. The lower part 33 of the block 30 is of a conventional form which will be appreciated by the skilled person, and as such will not be further described herein.

Figure 2:
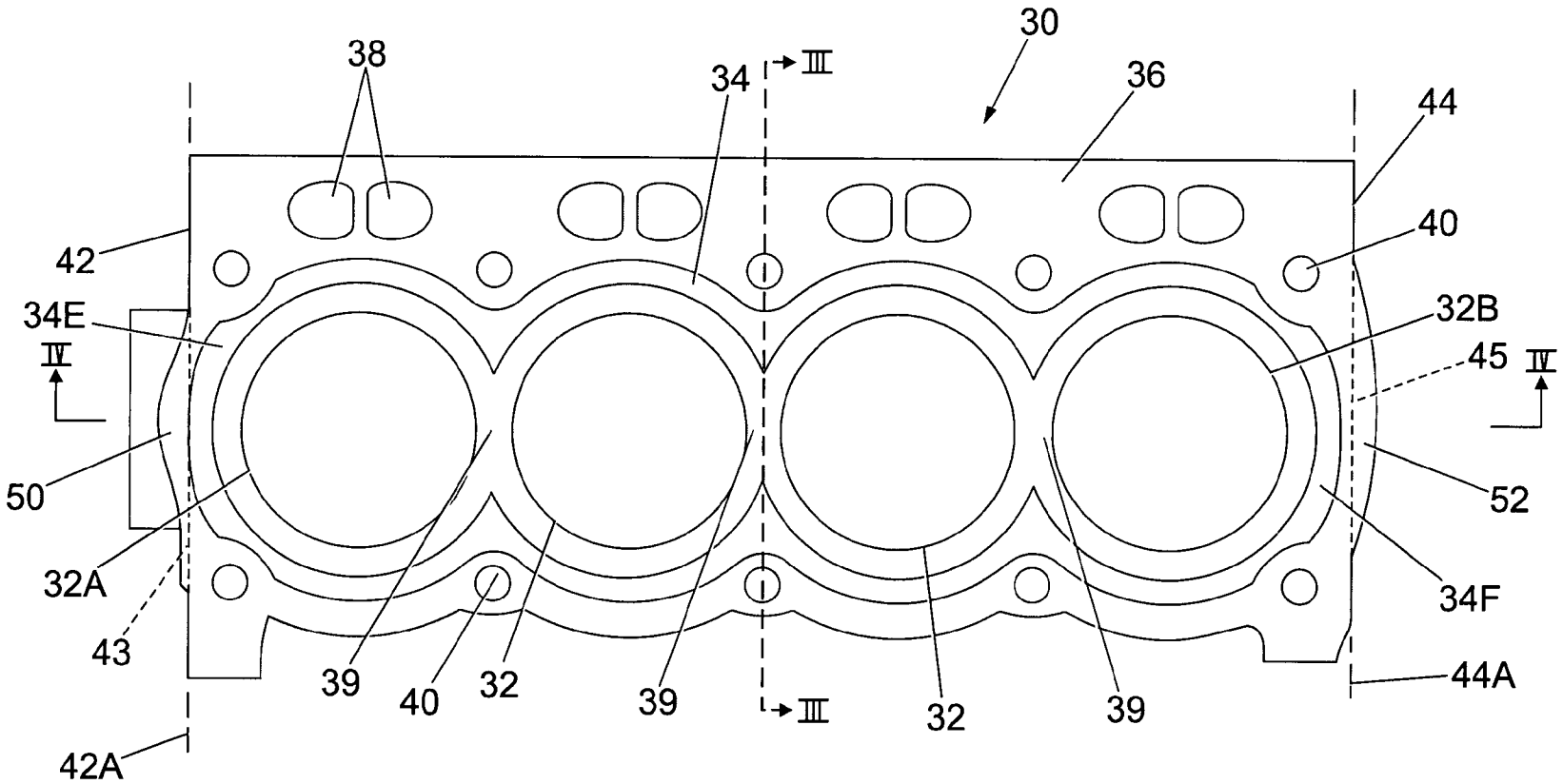
FIG. 2 is a plan view of the cylinder block of FIG. 1.

The aforementioned features of the upper part 31 of the block 30 can be seen clearly in FIG. 2. The upper part 31 has a first end wall surface 42 and a second end wall surface 44 which have first 42A and second 44A planes, respectively. The first and second end wall surfaces 42,44 are generally co-planar with respective first and second end wall surfaces 46,48 of the lower part 33. In other words, the first end wall surface 42 and second end wall surface 44 of the upper part 31 generally do not extend longitudinally beyond the first and second end wall surfaces 46,48 of the lower part 33. However, each of the first and second end wall surfaces 42,44 of the upper part 31 are provided with first and second projecting portions 50,52 which curve outwardly from the respective planes of the first and second end wall surfaces 42,44, generally following the curvature of the first and second outermost cylinder bores 32A,32B.

Figure 3:
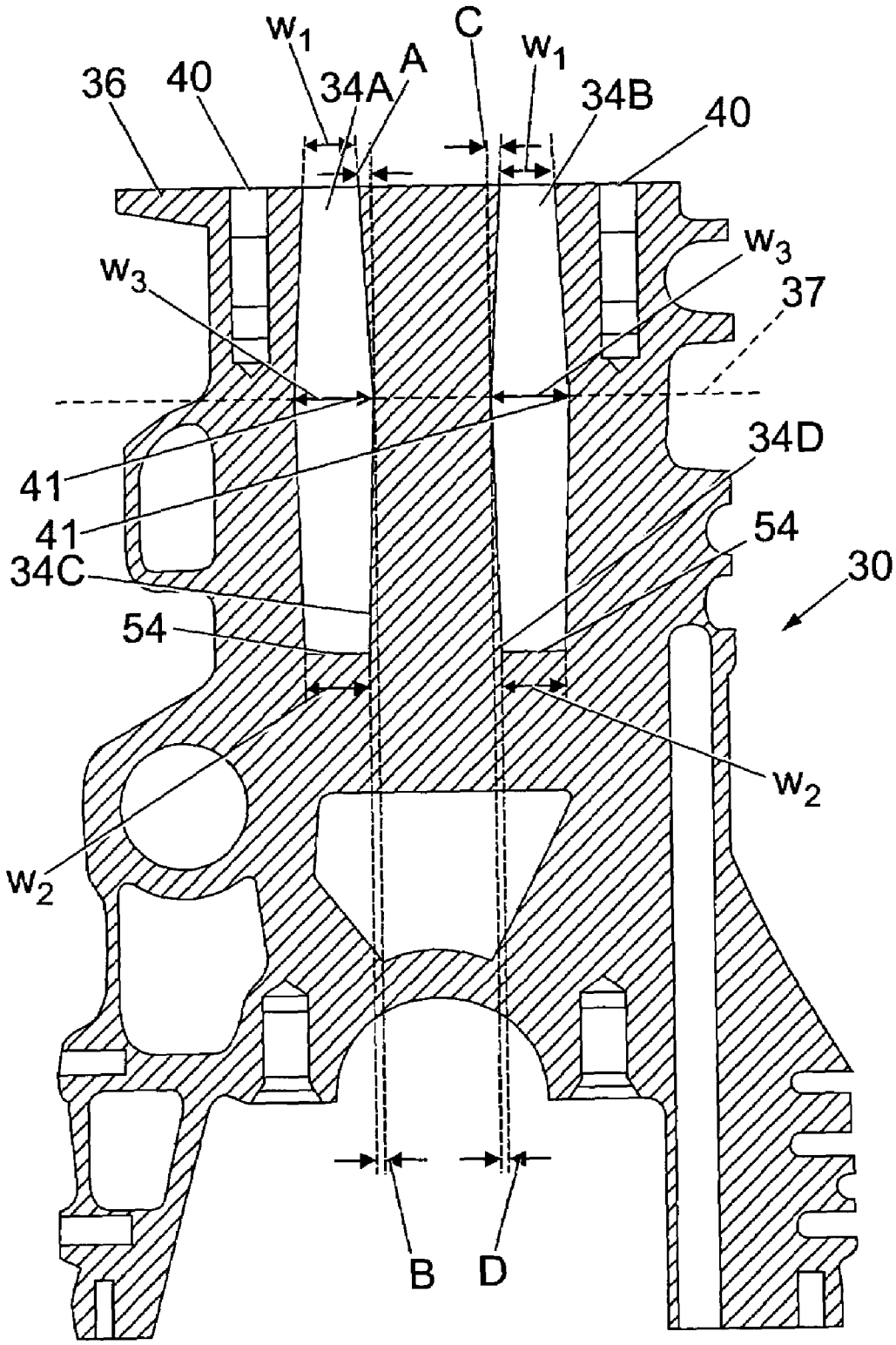
FIG. 3 is a transverse cross sectional view of the cylinder block of FIG. 2 through line III—III.

FIG. 3 shows a cross section through the block 30 along line III—III of FIG. 2. From this figure the tapering of the water jacket 34 in the transverse direction can be seen. The water jacket 34 widens as viewed in this transverse section from a first upper width W1 at upper portion 34A,34B adjacent the top deck 36 downwards until it reaches a third intermediate width W3 at intermediate portion 41. The split or casting line 37 of the block, where the two parts of the block mould meet, is generally co-planar with the intermediate portion 41 of the water jacket 34.

Continuing downwards, the water jacket 34 then narrows as viewed in this transverse section from the intermediate portion 41 to a second lower width W2 at lower portion 34C,34D adjacent its base, or floor 54. The amount of narrowing or widening will depend on the degree of taper A,C of the water jacket 34 between the top deck 36 and intermediate portion 41, which will correspond to that given to the sand cores in the core box 10, as will the amount of taper B,D between the intermediate depth 41 and the water jacket floor 54. The amount of taper A,B,C,D of the different portions of the water jacket 34 is preferably in the range of 1–10°. In the preferred embodiment the taper of each portion is 4°, but where appropriate the taper may be less than 1° or more than 10°. Although FIG. 3 only shows a selected transverse cross section of the block 30, the water jacket 34 is tapered in this manner along both longitudinal sides and both ends of the block 30. The taper may vary according to the position on the block 30.

Figure 4:
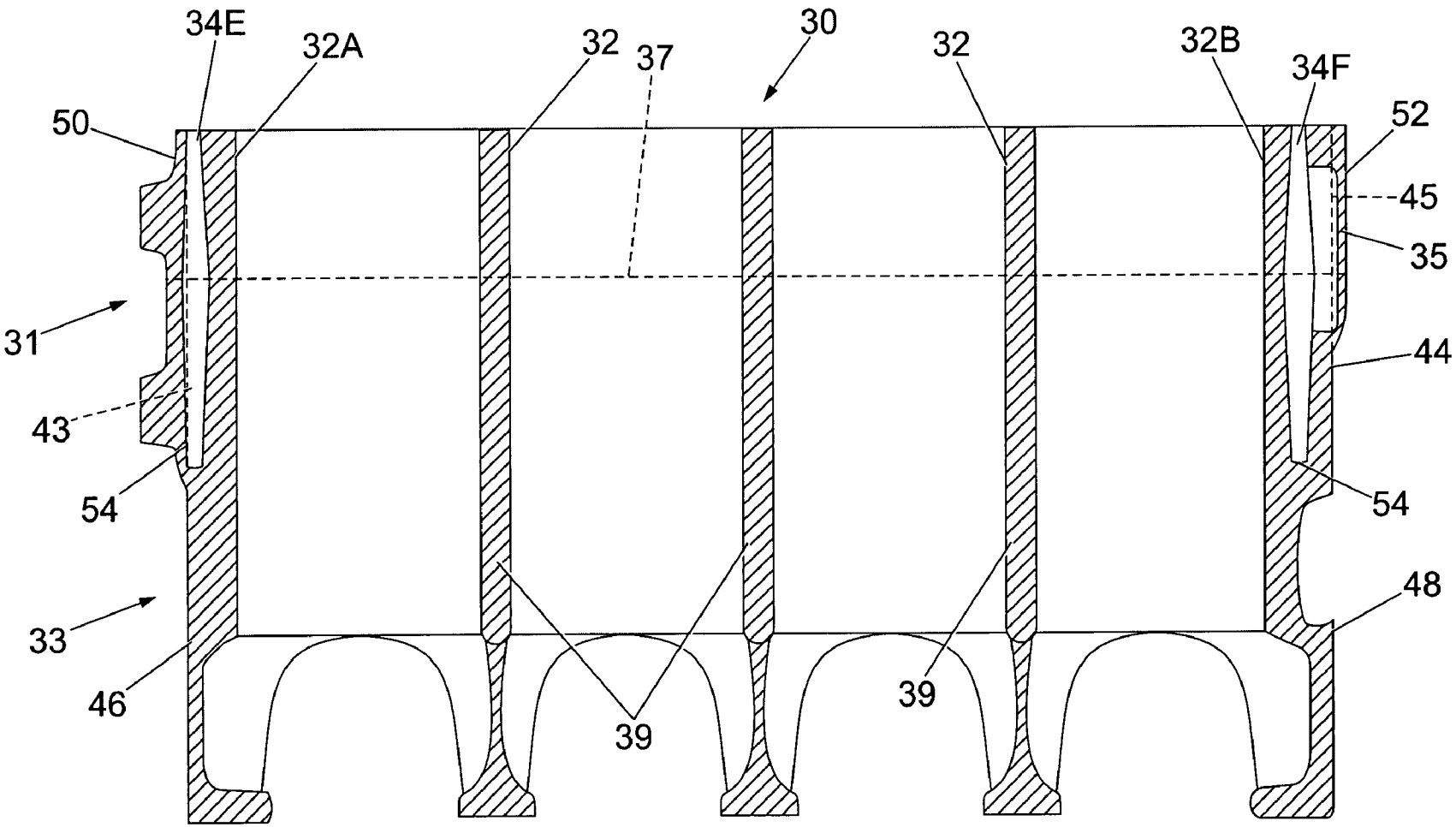
FIG. 4 is a longitudinal cross sectional view of the cylinder block of FIG. 2 through line IV—IV.

The water jacket 34 has two substantially transverse portions 34E,34F which lie between the first end wall surface 42 and first outermost cylinder bore 32A and the second end wall surface 44 and second outermost cylinder bore 32B, respectively, seen in section in FIG. 4.

FIG. 4 shows the block 30 in longitudinal section along line IV—IV of FIG. 2. FIG. 4 illustrates the extent to which the projecting portions 50,52 project from the first and second end wall surfaces 42,44 of the upper part 31. The purpose of the projecting portions 50,52 is to allow the first and second transverse portions 34E,34F of the water jacket 34 to be wider—at least in part—without substantially adding to the overall size or weight of the cylinder block 30.

The normal extent of the first end wall surface 42 is shown as a broken line 43 in FIG. 4. It can be seen that to accommodate larger cylinder bores in the existing compact block, the space for the water jacket would have been very narrow, given that the outer wall must be of sufficient width so as to provide strength to the block 30. Thus, at the first end wall surface 42 of the upper part 31 of the block 30, the first projecting portion 50 has been added to extend the length of the block 30 beyond the normal extent line 43. The projecting portion 50 extends outwardly from the top deck 36 and down the first end wall surface 42, but it should be noted that the vertical depth of the projecting portion 50 does not substantially exceed the depth of the water jacket 34. The remainder of the first end wall surface 42 is still substantially co-planar with the first end wall surface 46 of the lower part 33, but the transverse portion 34E of the water jacket 34 is wider than would be possible without the projecting portion 50.

At the second end wall surface 44 of the upper part 31 of the block 30, the normal extent of the second end wall surface 44 is shown as a broken line 45. The second projecting portion 52 projects beyond the normal extent line 45 and allows the transverse portion 34F of the water jacket 34 to be widened in the same manner as at the first end wall surface 42. However, although it too extends downwards from the top deck 36, the second projecting portion 52 does not extend as deep as the depth of the water jacket 34. This is so as not to interfere with a flywheel housing (not shown) which is located adjacent the second end wall surface 44 after the engine is assembled. As a result only an intermediate section 35 of the transverse portion 34F of the water jacket 34 is widened, such that the width of the intermediate section 35 is greater than the widths of the upper and lower sections.

As can be seen in FIG. 4, the substantially transverse end portions of the water jacket 34E, 34F adjacent the two outermost cylinder bores are tapered in the same manner as the substantially longitudinal portions of the water jacket 34 illustrated in FIG. 3, although the magnitude of the taper may vary. FIG. 4 illustrates the depth of the water jacket 34, which terminates at the water jacket floor 54. The depth of the water jacket 34 ensures that the combustion portion of each bore 32—the portion which will experience the most extreme pressure and temperature—will be sufficiently cooled as the depth of the jacket extends at least as deep as the combustion portions of the bores 32.

Figure 5:
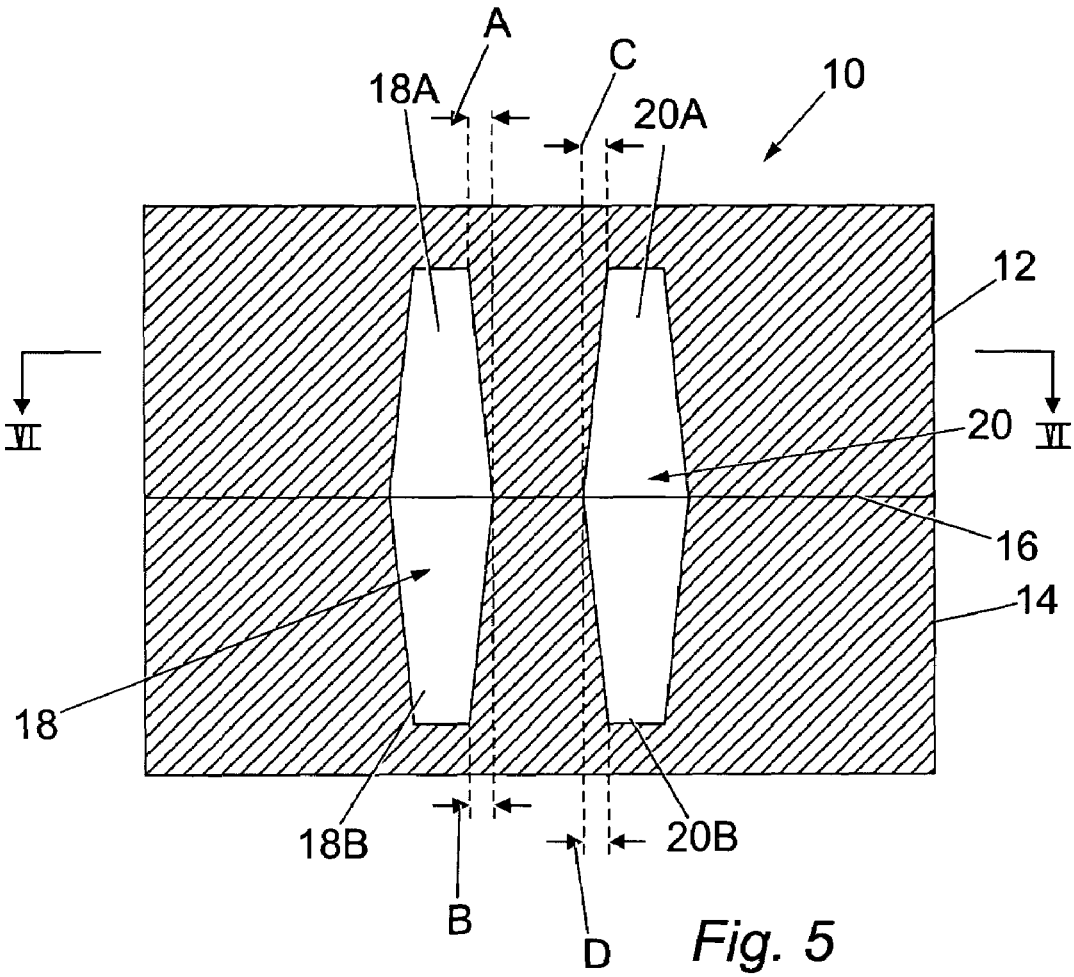
FIG. 5 is a vertical cross-section along the transverse axis of a sand core box used in the manufacture of the cylinder block of FIG. 1.
Figure 6:
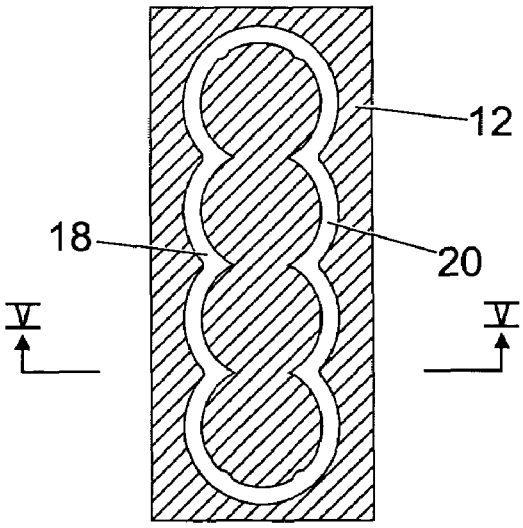
FIG. 6 is a cross-sectional view of the sand core box of FIG. 5 through line VI—VI.

The core box 10 shown in FIGS. 5 and 6 is comprised of an upper part 12 and a lower part 14 which are detachable from one another. The box 10 is provided with a split line 16 between the upper and lower parts 12,14 which, unlike conventional cylinder block core boxes, is at an intermediate height on the box 10. In this particular embodiment, the split line 16 is located midway up the box 10. With conventional cylinder block boxes, the split line is normally adjacent either the top or bottom of the box.

Each of the upper and lower parts 12,14 are provided with first and second shaped recesses 18A,18B,20A,20B where the recesses 18A,20A in the upper part 12 co-operate with the recesses 18B,20B in the lower part 14 to form volumes

18,20 into which sand or other suitable material can be poured to create cores for use in casting.

Each of the recesses 18A,18B,20A,20B has an inward taper such that the width of the recesses 18A,18B,20A,20B reduces when viewed in transverse section in either the upward or downward direction away from the split line 16. Each of the recesses 18A,18B,20A,20B has a respective amount of taper A,B,C,D in the range of 1–10°, but in the preferred embodiment the taper is 4°. Where appropriate tapers outside the range of 1–10° may be used. Each recess can have an individual amount of taper depending on desired specifications for the engine block for which the cores are being formed. The tapers of the upper recesses 18A, 20A may differ from the tapers of the lower recesses 18B, 20B. As a result of the tapers A,B,C,D, the portions of the recesses 18A,18B,20A,20B furthest from the split line 16 are narrower when viewed in transverse section than the portions at the split line 16. Providing the split line in the middle of the box 10 allows this double taper of each volume 18,20 which is not possible with conventional core boxes.

In use, the sand cores are moulded in the conventional manner, and this process will not be further described here. However, as the volumes 18,20 narrow when viewed in transverse section in both the upward and downward directions, once the cores have been moulded the upper part 12 of the core box 10 can be lifted off leaving the cores in the lower part 14 of the box. The cores can then simply be lifted out of the lower part 14 when needed.

The block 30 of FIG. 1 may be cast using the sand cores produced using the core box 10 of FIGS. 5 and 6. The intermediate portion 41 of the block 30 corresponds to the intermediate depth of the core box volumes 18,20 where the core box split line 16 is located, as the water jacket profile is defined by the sand cores created in the core box 10. In addition, the parting line or casting line 37 of the block 30—where the two parts of the block mould meet—is also co-planar with the intermediate portion 41 of the water jacket 34. The taper the water jacket 34 corresponds to the taper of the sand cores in the core box 10. It is to be understood that a cylinder block having a closed top deck (not shown) could also be cast in this way.

INDUSTRIAL APPLICABILITY

The provision of the projecting portions 50,52 on each end wall surface 42,44 of the upper part 31 of the block 30 means that the transverse portions 34A,34B of the water jacket may be wider than if the diameter of the cylinder bores was increased without increasing the overall size of the block itself. From FIG. 3, it can be seen that at least part of each of the transverse portions 34A,34B of the water jacket 34 lies in the plane of the first or second end wall surface 42,44, respectively. This would clearly not be possible without the provision of the projecting portions 50,52.

As previously discussed, it is desirable to increase the diameter—and hence the cubic capacity—of the cylinder bores without increasing the length of the block. However, if the external shape of the block is unchanged, the transverse portions of the water jacket are too thin over the whole depth of the water jacket for them to be successfully cast in the block. With the present invention, accommodation of wider transverse portions of the water jacket is possible but, as the dimensions of the block other than the projecting portions remain the same, the overall dimensions of the block are still compact. Thus, bores of greater diameter can be cast in a compact block without encountering casting problems due to the transverse portions of the water jacket being excessively thin.

The present invention provides a cylinder block with a water jacket which has a double taper when viewed in transverse section. This double taper permits the water jacket to be narrower at both top and bottom. Being narrow at the top allows more room for the addition of machined features post-casting, and also permits thicker bore walls in the combustion portion of the bore. Being narrow at the bottom allows for the jacket to have a greater depth than possible with the water jackets of conventional open deck cylinder blocks, which are usually moulded as part of the head core.

Having an open deck construction means that the engine will produce less noise during operation, as the combustion portion of the bores is isolated from the outer walls of the block by the water jacket. An open deck arrangement also allows easier visual inspection and cleaning of the block post-casting or machining. The combination of an open top deck and double tapered water jacket promotes better cooling around the cylinder bores, as the jacket extends to the top of the deck of the block.

Modifications and improvements may be incorporated without departing from the scope of the present invention. For example, although the water jacket on either longitudinal side of the block is shown to have the same degree of taper for both the upper and lower portions, the water jacket on one side of the block may have a different degree of taper within the 1–10° range for either one or both of its upper and lower portions than that of the other side, if desired. It will also be appreciated that although a four cylinder, in-line engine is described in the above embodiment, variations in terms of number of cylinders and layout thereof may also be employed with the present invention. Although the above embodiment describes projecting portions on both end walls of the block, the present invention could equally only have a projecting portion on one end wall of the block if desired. Furthermore, although only one of the transverse portions of the water jacket is shown to have an intermediate width greater than its upper and lower widths, both transverse portions of the jacket could be in this form. The transverse portions of the water jacket may also be widened further such that they are located at least partially within the projecting portions if necessary. It will also be clear that the present invention may also be applied to closed deck blocks if desired.

What is claimed is:

1. A cylinder block for an internal combustion engine, comprising:

at least one cylinder bore;

a coolant jacket at least partially surrounding the at least one cylinder bore;

a top deck; and first and second longitudinally opposed end walls, each of the first and second end walls having a substantially planar end wall surface arranged on respective first and second planes;

wherein the coolant jacket includes a first portion located between the first end wall and the at least one cylinder bore, and a second portion located between the second end wall and the at least one cylinder bore; and wherein at least one of the first and second end walls includes a projecting portion adjacent the top deck which projects longitudinally beyond the first or second plane, the projecting portion having a first vertical depth, and at least one of the first and second portions of the coolant jacket having a second vertical depth, and wherein the first vertical depth of the projecting portion does not substantially exceed the second vertical depth of the coolant jacket.

2. The cylinder block of claim 1, wherein each of the first and second end walls includes a projecting portion adjacent the top deck which projects longitudinally beyond the respective first or second plane.

3. The cylinder block of claim 2, wherein the projecting portions have the first vertical depth and a third vertical depth, respectively, and both the first and second portions of the coolant jacket have the second vertical depth, and neither of the first or third depths substantially exceeds the second vertical depth of the coolant jacket.

4. The cylinder block of claim 2, wherein the first and second coolant jacket portions are located at least partially within the projecting portions.

5. The cylinder block of claim 3, wherein the first and second coolant jacket portions are located at least partially within the projecting portions.

6. The cylinder block of claim 1, wherein at least part of each of the first and second coolant jacket portions are co-planar with the first and second planes, respectively.

7. The cylinder block of claim 2, wherein at least part of each of the first and second coolant jacket portions are co-planar with the first and second planes, respectively.

8. The cylinder block of claim 3, wherein at least part of each of the first and second coolant jacket portions are co-planar with the first and second planes, respectively.

9. The cylinder block of claim 4, wherein at least part of each of the first and second coolant jacket portions are co-planar with the first and second planes, respectively.

10. A cylinder block for an internal combustion engine, comprising:

at least one cylinder bore;

a coolant jacket at least partially surrounding the at least one cylinder bore;

a top deck; and first and second longitudinally opposed end walls, each of the first and second end walls having a substantially planar end wall surface arranged on respective first and second planes;

wherein the coolant jacket includes a first portion located between the first end wall and the at least one cylinder bore, and a second portion located between the second end wall and the at least one cylinder bore; and wherein at least one of the first and second end walls includes a projecting portion adjacent the top deck which projects longitudinally beyond the first or second plane, wherein said first and second coolant jacket portions have an upper width, a lower width and an intermediate width, and wherein at least one of the first and second coolant jacket portions has an intermediate width which is greater than its upper and lower widths.

11. The cylinder block of claim 2, wherein said first and second coolant jacket portions have an upper width, a lower width and an intermediate width, and wherein at least one of the first and second coolant jacket portions has an intermediate width which is greater than its upper and lower widths.

12. The cylinder block of claim 3, wherein said first and second coolant jacket portions have an upper width, a lower width and an intermediate width, and wherein at least one of the first and second coolant jacket portions has an intermediate width which is greater than its upper and lower widths.

13. The cylinder block of claim 4, wherein said first and second coolant jacket portions have an upper width, a lower width and an intermediate width, and wherein at least one of the first and second coolant jacket portions has an intermediate width which is greater than its upper and lower widths.

14. The cylinder block of claim 6, wherein said first and second coolant jacket portions have an upper width, a lower width and an intermediate width, and wherein at least one of the first and second coolant jacket portions has an intermediate width which is greater than its upper and lower widths.

15. The cylinder block of claim 1, wherein the at least one cylinder bore is a linerless cylinder bore.

16. The cylinder block of claim 1, wherein the block comprises at least two cylinder bores, the bores having conjoined cylinder walls.

17. The cylinder block of claim 1, wherein the projecting portions are curved projections.

18. A cylinder block for an internal combustion engine, the cylinder block including an upper part and a lower part, the upper part comprising:

at least one cylinder bore;

a coolant jacket at least partially surrounding the at least one cylinder bore;

a top deck; and first and second longitudinally opposed end walls, each of the first and second end walls having a substantially planar end wall surface arranged on respective first and second planes;

wherein the coolant jacket includes a first portion located between the first end wall and the at least one cylinder bore, and a second portion located between the second end wall and the at least one cylinder bore; and wherein at least one of the first and second end walls includes a projecting portion adjacent the top deck which projects longitudinally beyond the first or second plane, the projecting portion having a first vertical depth, and at least one of the first and second portions of the coolant jacket having a second vertical depth, and wherein the first vertical depth of the projecting portion does not substantially exceed the second vertical depth of the coolant jacket.

19. The cylinder block of claim 18, wherein each of the first and second end walls includes a projecting portion adjacent the top deck which projects longitudinally beyond the respective first or second plane.

20. The cylinder block of claim 19, wherein the projecting portions have the first vertical depth and a third vertical depth, respectively, and the first and second portions of the coolant jacket each have the second vertical depth, and neither of the first or third depths substantially exceeds the second vertical depth of the coolant jacket.

* * * * *